US005214806A

United States Patent [19]

Flores

[11] Patent Number: 5,214,806

[45] Date of Patent: Jun. 1, 1993

[54] INFANT GARMENT BAND APPARATUS

[76] Inventor: Cynthia V. Flores, Rte. 3, Box 140, Mission, Tex. 78592

[21] Appl. No.: 846,037

[22] Filed: Mar. 5, 1992

[51] Int. Cl.[5] ..... A41F 5/00

[52] U.S. Cl. ..... 2/312; 2/300; 2/315; 2/338

[58] Field of Search ..... 2/300, 302, 304, 307, 2/312, 314, 315, 326, 338, 80, 70, 111, 307, 312, 317, 323, 107, 112; 446/26, 28

[56] References Cited

U.S. PATENT DOCUMENTS

| | | | |
|---|---|---|---|
| 398,046 | 2/1889 | Hollis | 2/302 |
| 583,796 | 6/1897 | Ferrell | 2/300 |
| 1,338,859 | 5/1920 | Fogg | 2/300 |
| 1,374,572 | 4/1921 | Hurd | 2/315 |
| 1,497,784 | 6/1924 | Gunn | 2/111 |
| 1,570,492 | 1/1926 | Jackson | 2/315 |
| 1,642,105 | 9/1927 | Eastin | 2/302 |
| 2,115,075 | 4/1938 | Karger | 2/338 |
| 2,568,304 | 9/1951 | Schoenbrun | 2/302 |
| 3,458,188 | 7/1969 | Infante | 2/312 |
| 3,530,031 | 9/1970 | Loew | 2/338 |
| 4,151,936 | 5/1979 | Hawkes | 2/338 |
| 4,847,919 | 7/1989 | Haung et al. | 2/338 |
| 4,947,489 | 8/1990 | Greenwood | 2/304 |
| 5,023,956 | 6/1991 | Fox | 2/338 |

FOREIGN PATENT DOCUMENTS

| | | | |
|---|---|---|---|
| 296480 | 4/1916 | Australia | 2/312 |

*Primary Examiner*—Clifford D. Crowder
*Assistant Examiner*—Amy Brooke Vanatta
*Attorney, Agent, or Firm*—Leon Gilden

[57] ABSTRACT

An infant garment band including fastener ends to secure the band in surrounding relationship relative to a waist portion of an infant is provided to include a plurality of fastener members extending above and below the band for securement of an infant tee shirt and diaper relative to the infant. A modification of the invention includes a locking loop directed through a forward surface of the band through the fastener portion for mounting a tether line thereto, wherein the apparatus further is arranged to provide for securement clasps mounted to a rear surface of the band to permit securement of the band and the infant relative to a cart structure and the like preventing inadvertent and accidental loss of the infant from such transport vehicles.

3 Claims, 4 Drawing Sheets

INFANT GARMENT BAND APPARATUS

BACKGROUND OF THE INVENTION

1. Field of the Invention

The field of invention relates to infant apparatus, and more particularly pertains to a new and improved infant garment band apparatus wherein the same is arranged for securement about a torso portion of an individual for securement of infant garments to the infant.

2. Description of the Prior Art

Infant tee shirts and diapers due to the physiological configuration of infants are prone to displacement relative to the infant, wherein the instant invention attempts to overcome deficiencies of the prior art by providing for a securement band apparatus to maintain proper positioning of infant garments relative to the infant. Prior art support structure is exemplified by U.S. Pat. No. 4,481,682 to Hall setting forth a suspender structure for supporting pants and the like to an individual.

U.S. Pat. No. 3,932,897 to Young sets forth a hockey garter belt wherein a flexible belt includes band members directed downwardly therefrom.

U.S. Pat. No. 4,285,069 to Hall sets forth a garter belt structure utilizing downwardly directed support bands.

U.S. Pat. No. 4,947,489 to Greenwood sets forth a garment support structure utilizing a garment mounting a suspender-like member directed downwardly therefrom for securement to a diaper and the like about an infant.

As such, it may be appreciated that there continues to be a need for a new and improved infant garment band apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of garment support apparatus now present in the prior art, the present invention provides an infant garment band apparatus arranged to include upwardly and downwardly projecting straps relative to a band structure for securement of garment portions to an infant. As such, the general purpose of the present invention, which will be described subsequently in greater detail, is to provide a new and improved infant garment band apparatus which has all the advantages of the prior art garment support apparatus and none of the disadvantages.

To attain this, the present invention provides an infant garment band including fastener ends to secure the band in surrounding relationship relative to a waist portion of an infant to include a plurality of fastener members extending above and below the band for securement of an infant tee shirt and diaper relative to the infant. A modification of the invention includes a locking loop directed through a forward surface of the band through the fastener portion for mounting a tether line thereto, wherein the apparatus further is arranged to provide for securement clasps mounted to a rear surface of the band to permit securement of the band and the infant relative to a cart structure and the like preventing inadvertent and accidental loss of the infant from such transport vehicles.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved infant garment band apparatus which has all the advantages of the prior art garment support apparatus and none of the disadvantages.

It is another object of the present invention to provide a new and improved infant garment band apparatus which may be easily and efficiently manufactured and marketed.

It is a further object of the present invention to provide a new and improved infant garment band apparatus which is of a durable and reliable construction.

An even further object of the present invention is to provide a new and improved infant garment band apparatus which is susceptible of a low cost of manufacture with regard to both materials and labor, and which accordingly is then susceptible of low prices of sale to the consuming public, thereby making such infant garment band apparatus economically avaiable to the buying public.

Still yet another object of the present invention is to provide a new and improved infant garment band apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to the forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
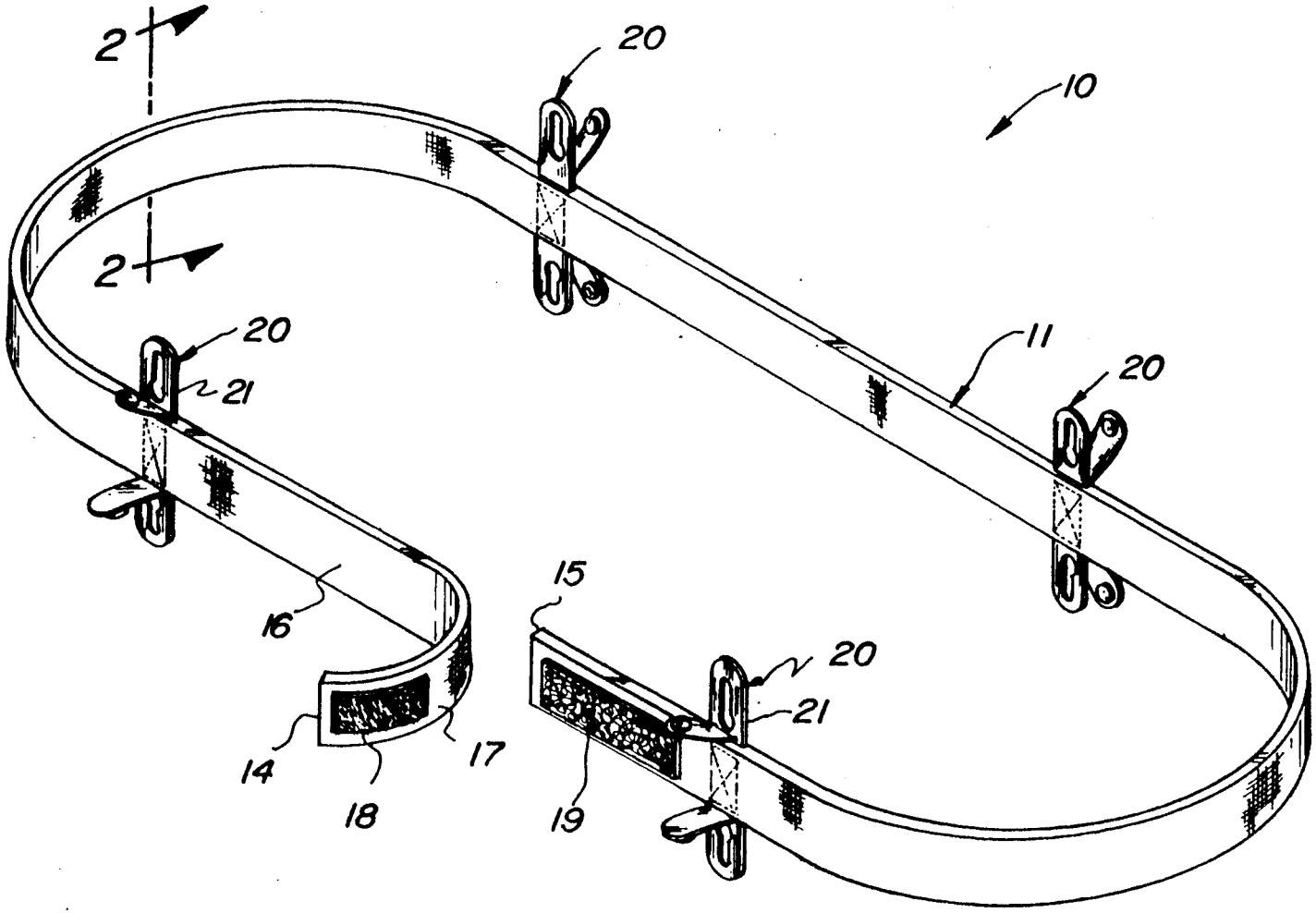
FIG. 1 is an isometric illustration of the instant invention.
Figure 3:
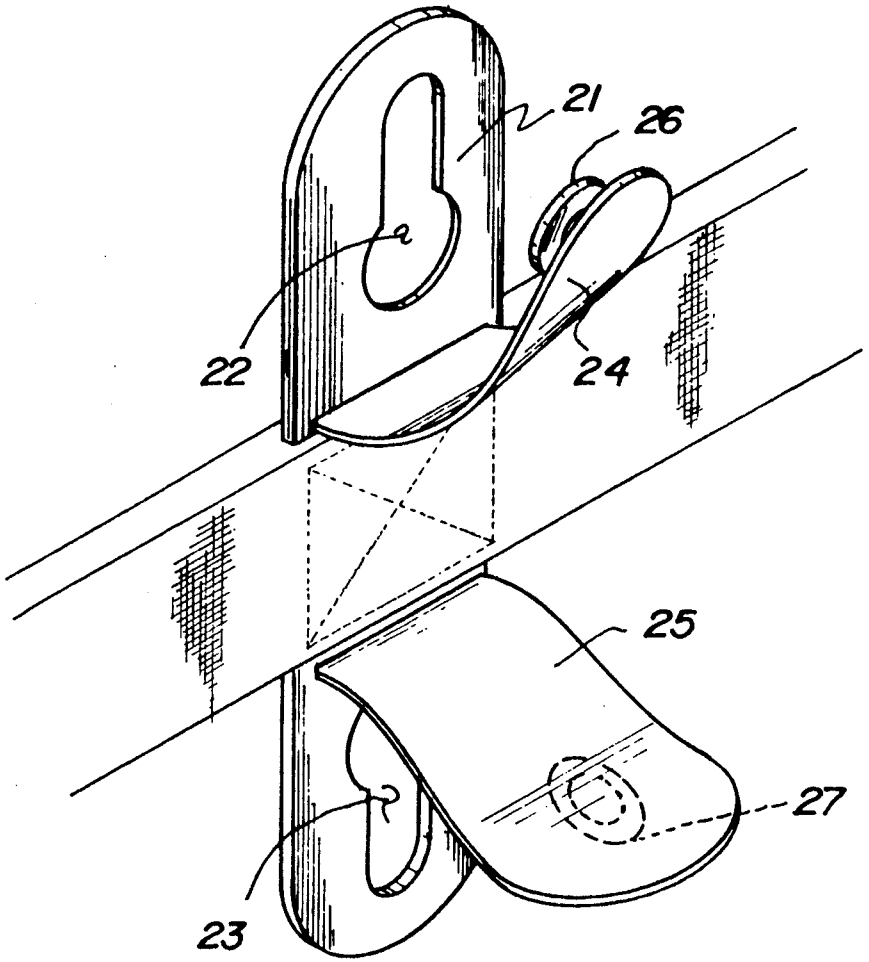
FIG. 3 is an isometric enlarged illustration of a clasp member utilized by the invention.
Figure 2:
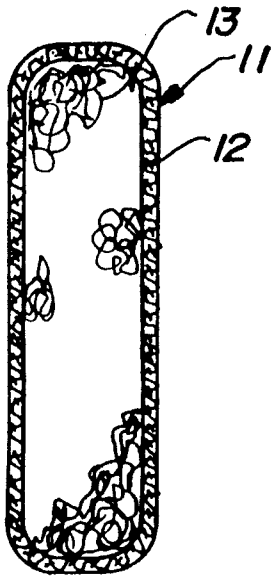
FIG. 2 is an orthographic view, taken along the lines 2—2 of FIG. 1 in the direction indicated by the arrows.

With reference now to the drawings, and in particular to FIGS. 1 to 6 thereof, a new and improved infant garment band apparatus embodying the principles and concepts of the present invention and generally designated by the reference numerals 10 and 10*a* will be described.

More specifically, the infant garment band apparatus 10 of the invention essentially comprises a flexible tubular band 11 including a generally flat outer wall 16 spaced from and parallel to a flat inner wall 17. The band 11 includes a band cavity 12 therethrough, including a fibrous filler material 13 coextensively directed throughout the cavity for cushioning of the band structure when secured about a waist portion of an infant. A band first end 14 is positioned for securement relative to a band second end 15, wherein a first hook and loop fastener patch 18 mounted to the flat inner wall 17 adjacent the first end 14 is arranged for securement to a second hook and loop fastener patch 19 positioned to the outer wall 16 adjacent the second end 15. A plurality of clasp members 20 projecting above and below the band orthogonally oriented relative to the band are spaced at predetermined intervals along the band 11, in a manner as illustrated in FIG. 1. Each clasp member 20 includes an elongate web 21 directed through the band between the outer and inner walls 16 and 17 that extends above and below the band. An upper keyhole opening 22 is directed through the web 21 above the band and a lower keyhole opening 23 is directed through the web below the band. An upper flexible flap 24 hingedly mounted to the web 21 adjacent the band 11 includes an upper flap ring 26 arranged for reception within the upper keyhole opening 22 for capturing a garment between the upper ring 26 and the web 21 above the band. The lower keyhole opening 23 cooperates with a lower flap ring 27 mounted to a lower flap 25 that is hingedly mounted to the web adjacent the band to permit securement of a diaper and the like between the lower flap 25 and the web 21 directed below the band 11.

Figure 4:
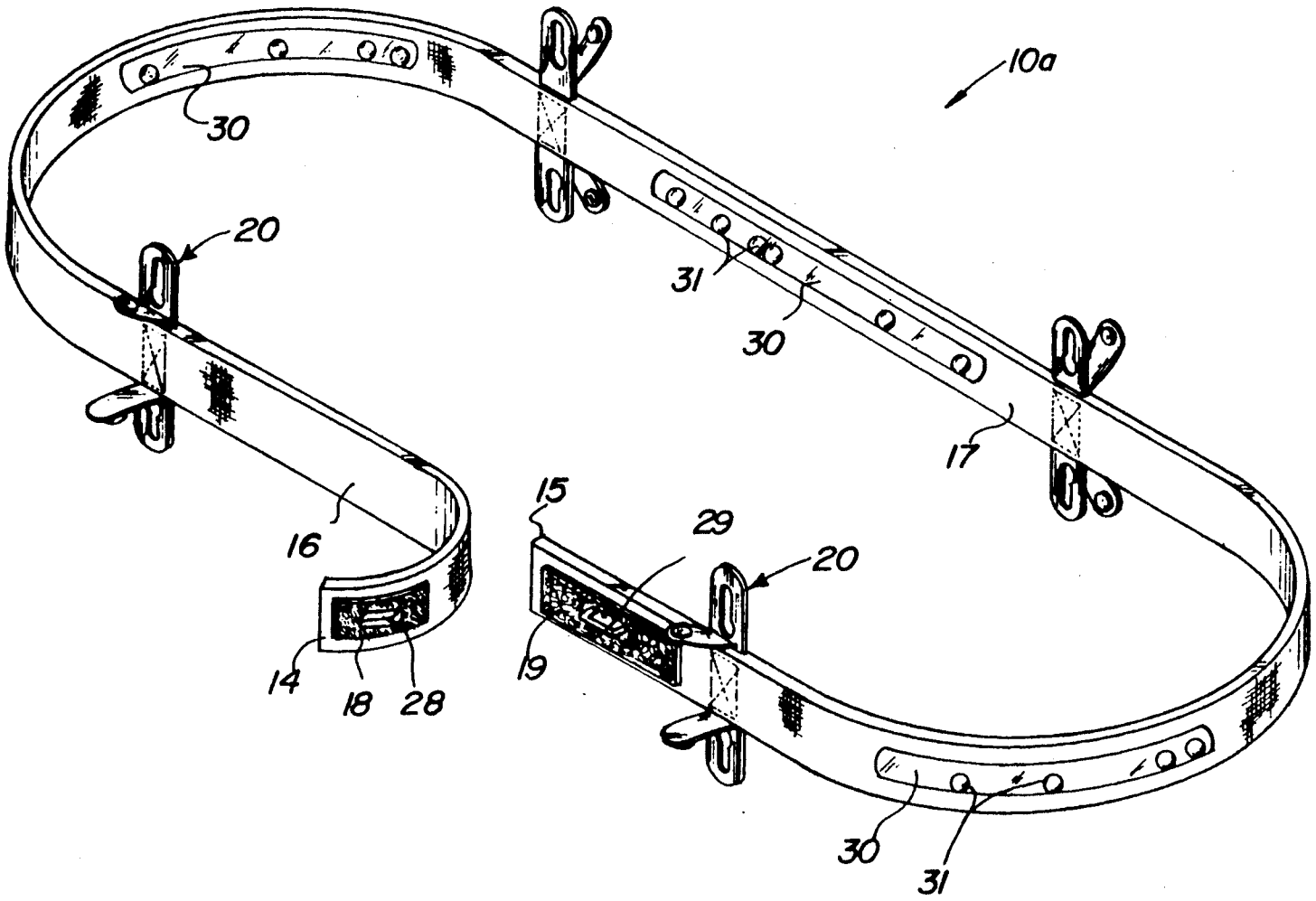
FIG. 4 is an isometric illustration of a modification of the invention.

The apparatus 10*a* as illustrated in the FIG. 4 for example employs a slot 28 directed through the band contained within the first hook and loop fastener patch 18 that is arranged to receive a rigid loop 29 fixedly mounted to the second hook and loop fastener patch 19, whereupon projection of the rigid loop 29 through the slot 28 permits securement of a tether and the like relative to the band structure while simultaneously latching the band first end 14 relative to the band second end 15 when positioned about an infant's waist. A plurality of transparent elongate flexible housings 30 are directed into the band directed through the inner and outer walls, with the transparent flexible housings 30 including a plurality of rattle rollers 31 therewithin for amusement of an infant during wearing of the band structure to induce an infant to avoid attempting to remove the band enjoying its mounting about the infant's waist portion in use.

Figure 6:
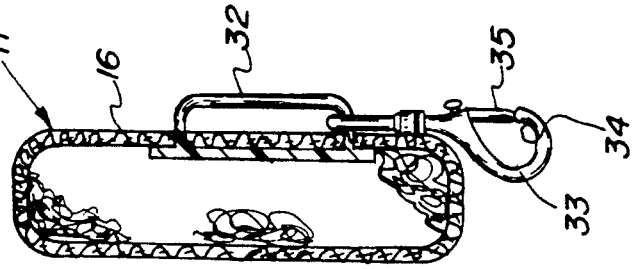
FIG. 6 is an orthographic view, taken along the lines 6—6 of FIG. 5 in the direction indicated by the arrows.
Figure 5:
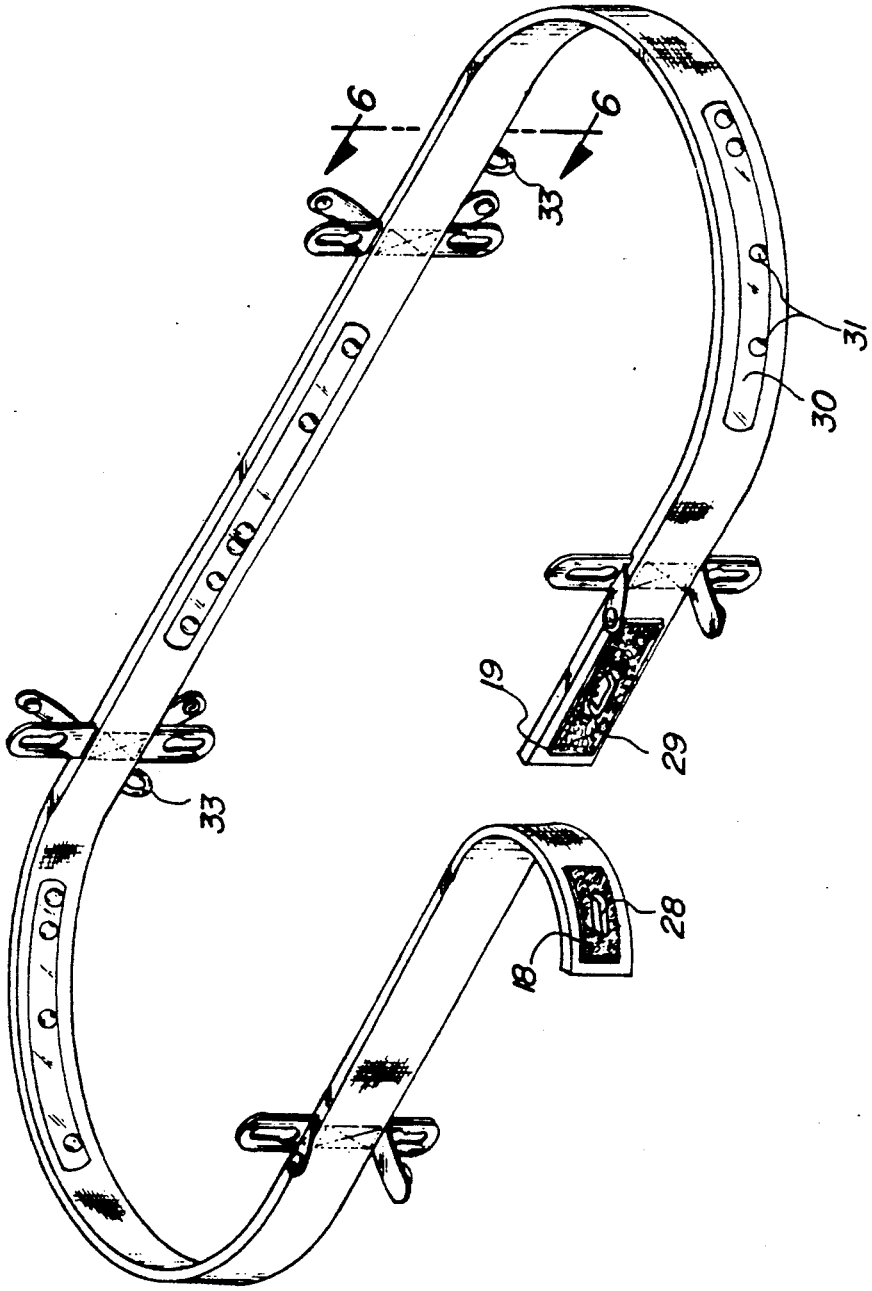
FIG. 5 is an isometric illustration of the modified invention further employing fastener clamp members.

The FIG. 5 further employs a plurality of outer wall loops 32, as illustrated in the FIG. 6 for example, wherein the outer wall loops fixedly mounted to the outer wall 16, each slidably mount a fastener clamp member 33 thereto. Each fastener clamp member 33 includes a clamp loop 34 including a reciprocating leg 35 directed from the clamp member permitting opening of the loop for reception of various support tethers such as may be found in various infant transport vehicles to secure the infant relative to the transport vehicle (not shown).

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An infant garment band apparatus, comprising, a flexible tubular band, the flexible tubular band including a band cavity directed coextensively therethrough, and a cushion filler material directed coextensively throughout the cavity for effecting cushioning of the band when positioned about an infant's waist, and the band including a first end and a band second end, and the band including a flat outer wall spaced from a flat inner wall, and a first hook and loop fastener patch secured to the band inner wall adjacent the first end, and a second hook and loop fastener patch selectively securable to the first hook and loop fastener patch, the second hook and loop fastener patch mounted to the outer wall adjacent the band second end, and a plurality of clasp members mounted to the band and spaced about the band, and each clasp member includes an elongate web, the elongate web is oriented between the inner wall and the outer wall and extends above the band and below the band, and an upper keyhole opening directed through the web above the band, and a lower keyhole opening directed through the web below the band, and an upper flexible flap hingedly mounted to the web above the band, and a lower flexible flap hingedly mounted to the web below the band, and the upper flexible flap includes an upper flap ring selectively receivable within the upper keyhole opening, and the lower flexible flap including a lower flap ring for reception within the lower keyhole opening, and a plurality of transparent flexible housings mounted within the band and extending from the inner wall to the outer wall, the housings directed through the inner wall and the outer wall, and each of the housings include a plurality of rattle roller members rotatably mounted within the flexible housing.

2. An apparatus as set forth in claim 1 including at least one outer wall loop mounted to the outer wall, wherein the outer wall loop includes a fastener clamp member slidably mounted to the outer wall loop, the fastener clamp member forms a loop, and a reciprocating leg reciprocatably mounted to the clamp member to permit selective opening and closure of the loop for reception of a tether line therethrough.

3. An apparatus as set forth in claim 4 including an elongate slot directed through the band extending from the band inner wall to the band outer wall directed through and positioned within the first hook and loop fastener patch, and a further loop mounted fixedly to the second hook and loop fastener patch and arranged for reception through the slot permitting mounting of a harness to the further loop when said loop is directed through the slot.

* * * * *